US005594455A

United States Patent [19]

Hori et al.

[11] Patent Number: 5,594,455

[45] Date of Patent: Jan. 14, 1997

[54] BIDIRECTIONAL PRINTED ANTENNA

[75] Inventors: Toshikazu Hori; Keizo Cho, both of Kanagawa, Japan

[73] Assignee: Nippon Telegraph & Telephone Corporation, Tokyo, Japan

[21] Appl. No.: 488,055

[22] Filed: Jun. 7, 1995

[30] Foreign Application Priority Data

Jun. 13, 1994 [JP] Japan ..... 6-153122

[51] Int. Cl.[6] ..... H01Q 1/38; H01Q 21/00

[52] U.S. Cl. ..... 343/700 MS; 343/833; 343/846

[58] Field of Search ..... 343/700 MS, 795, 343/846, 725, 841, 833; H01Q 1/38, 21/00

[56] References Cited

U.S. PATENT DOCUMENTS 4,899,164 2/1990 McGrath ..... 343/700 MS

FOREIGN PATENT DOCUMENTS 3-254208 11/1991 Japan .

OTHER PUBLICATIONS

"Broadband Circularly Polarized Microstrip Array Antenna with Coplanar Feed", Hori et al, *Electronics and Communications in Japan,* Part 1, vol. 69, No. 11, 1986, pp. 76–83 No month.

*Microstrip Antennas,* Bahl et al, Artech House, USA, pp. 1–84 No date.

*Primary Examiner*—Michael C. Wimer

*Attorney, Agent, or Firm*—Nikaido Marmelstein Murray & Oram LLP

[57] ABSTRACT

A bidirectional printed antenna includes a dielectric substrate (33) having first and second surfaces which are substantially in parallel, at least one pair of radiation element conductors (31, 32) having the same shape and the same size, each pair of which is arranged on the first and second surfaces at positions opposing with each other, respectively, a feeding circuit (34, 35, 36, 37) coupled to at least one edge of each of the radiation element conductors, and a ground conductor (37) arranged on the second surface. The ground conductor (37) covers at least an area outside of the edge of the radiation element conductor, which edge is coupled to the feeding circuit, and an area outside of the opposite edge with respect to the radiation element conductor by leaving a gap of a predetermined width between the radiation element conductor and this ground conductor. The antenna further includes a first strip conductor (34, 35) arranged on the first surface and connected to the radiation element conductor (31) on the first surface, and a second strip conductor (36) arranged on the second surface, for connecting the radiation element conductor (32) on the second surface with the ground conductor. The above-mentioned feeding circuit includes an unbalanced feed line which consists of the ground conductor (37) and the first strip conductor (35), and a balanced feed line which consists of the first and second strip conductors (34, 36).

14 Claims, 12 Drawing Sheets

MAGNETIC FIELD
PLANE (H-PLANE)

ELECTRIC FIELD
PLANE (E-PLANE)

5dB/div

ELECTRIC FIELD
PLANE (E-PLANE)

ELECTRIC FIELD
PLANE (E-PLANE)

MAGNETIC FIELD
PLANE (H-PLANE)

BIDIRECTIONAL PRINTED ANTENNA

FIELD OF THE INVENTION

The present invention relates to a simple and highly efficient printed antenna having a bidirectional radiation pattern spreading toward directions perpendicular to surfaces of its printed substrate. Particularly, the present invention relates to a bidirectional printed antenna which is appropriate to a base station antenna for a street microcell in a personal communication system.

DESCRIPTION OF THE RELATED ART

In a personal communication system such as PHS (Personal Handyphone System), it is desired to realize a highly efficient base station antenna which is specially suited for its microcells. For a base station antenna of the microcell, especially of a street microcell having a cellular zone extending along a street, a bidirectional antenna having a radiation pattern which spreads along the street will be suited rather than a general rod antenna having an omnidirectional radiation pattern in the horizontal plane. This is because the former can increase the zone length of the street microcell. Furthermore, to attach many of antennas to street structures located along the side of the street, e.g. utility poles, the base station antennas should be constituted in simple and small. For satisfying these requirements, printed antennas such as microstrip antennas or parallel patch antennas may be best fitted.

The microstrip antenna of resonator type with a circular or rectangular shape is known, for example, by I. J. Bahl and P. Bhartia, "Microstrip Antennas", Artech House, USA, 1980. Since one surface of the microstrip antenna is necessarily made as a ground plane, this microstrip antenna has a single-directional pattern radiating from the other surface only. Therefore, in order to provide a bidirectional radiation pattern radiating from both surfaces of the antenna substrate by using the microstrip antennas, it is necessary to superpose two of them so that their ground planes are opposite with each other to synthesize the radiation patterns of the two microstrip antennas. However, such constitution causes antenna structure to complicate. Furthermore, it is difficult to obtain a bidirectional radiation pattern with good plane-symmetry because there may occur phase differences between the radiations from the microstrip antennas.

As another kind of the printed antenna, a parallel patch antenna is known. This antenna is constituted by a substrate and two parallel patches which have the same shape and the same size and printed on the both surfaces of the substrate at plane symmetrical positions, respectively.

FIG. 1*a* is an oblique view of an example of a conventional parallel patch antenna, FIG. 1*b* is a plane view indicating conductor pattern formed on the front surface of its substrate, and FIG. 1*c* is a plane view indicating conductor pattern formed on the rear surface of the substrate.

In these figures, reference numerals 11 and 12 denote radiation element conductors (radiation patches) formed in a predetermined pattern on the both surfaces of the dielectric substrate 13, respectively. On the front surface of the substrate 13, one end of a strip conductor 15 is coupled to the radiation patch 11 via a strip conductor 14. On the rear surface of the substrate 13, one side of a ground conductor 17 is coupled to the radiation patch 12 via a strip conductor 16. The parallel strip conductors 14 and 16 constitute a balanced feed line, and the strip conductor 15 and the ground conductor 17 constitute an unbalanced feed line. The other end of the strip conductor 15 is connected to a central conductor (not shown) of a connector 18 and the ground conductor 17 is connected to a ground conductor (not shown) of the connector 18.

FIGS. 2*a* and 2*b* show the measured result of the radiation characteristics of the above-mentioned conventional parallel patch antenna shown in FIGS. 1*a* to 1*c*. As shown in FIG. 2*a*, the radiation pattern of this antenna is bidirectional in the magnetic field plane (H-plane). However, as shown in FIG. 2*b*, the radiation pattern becomes omnidirectional or elliptic shape pattern in the electric field plane (E-plane). In this case, the E-plane is vertical plane perpendicular to the radiation patches 11 and 12, and the H-plane is horizontal plane also perpendicular to the radiation patches 11 and 12. The measurement of FIGS. 2*a* and 2*b* was carried out by using a Teflon glass laminated substrate 13, formed in a rectangular shape, having a relative dielectric constant of 2.55, thickness of 1.6 mm and size of about 10 cm×10 cm. Also, the radiation patches 11 and 12 were formed in a square shape and the measurement frequency was 2.2 GHz.

As will be apparent from the above description, the conventional parallel patch antenna shown in FIGS. 1*a* to 1*c* cannot expect bidirectional radiation characteristics in both the H-plane and the E-plane.

SUMMARY OF THE INVENTION

It is therefore an object of the present invention to provide a high radiating efficiency and high gain printed antenna having bidirectional radiation characteristics in both the magnetic field plane and the electric field plane.

According to the present invention, the above-mentioned object is achieved by a bidirectional printed antenna including a dielectric substrate having first and second surfaces which are substantially in parallel, at least one pair of radiation element conductors having the same shape and the same size, each pair of which is arranged on the first and second surfaces at positions opposing with each other, respectively, a feeding circuit coupled to at least one edge of each of the radiation element conductors, and a ground conductor arranged on the second surface. The ground conductor covers at least an area outside of the edge of the radiation element conductor by leaving a gap of a predetermined width between the radiation element conductor and this ground conductor, which edge is coupled to the feeding circuit, and an area outside of the opposite edge with respect to the radiation element conductor by leaving a gap of a predetermined width between the radiation element conductor and this ground conductor. The antenna further includes a first strip conductor arranged on the first surface and connected to the radiation element conductor on the first surface, and a second strip conductor arranged on the second surface, for connecting the radiation element conductor on the second surface with the ground conductor. The above-mentioned feeding circuit includes an unbalanced feed line which consists of the ground conductor and the first strip conductor, and a balanced feed line which consists of the first and second strip conductors.

In a parallel patch printed antenna which has radiation element conductors (radiation patches) formed on the both surfaces of a dielectric substrate in the same shape and the same size at plane symmetrical positions, the ground conductor is formed in the same surface as one of the radiation patches so that this ground conductor is not contact with this radiation patch by leaving a gap of a predetermined width between them. Therefore, the radiation pattern in the E-plane becomes bidirectional and also the directive gain increases. Thus, a bidirectional antenna with higher gain can be expected. Also, by forming this ground conductor over the remaining area, the feeding circuit to the radiation patches can be easily arranged by means of the unbalanced microstrip feed line on the substrate. Namely, according to the present invention, a printed antenna having a bidirectional radiation pattern in both the E-plane and the H-plane with good symmetry property and higher gain can be provided in a simple structure. Accordingly, the present invention can provide a bidirectional printed antenna which is appropriate to a base station antenna for a street microcell in a personal communication system.

Preferably, the ground conductor is arranged around the radiation element conductor by leaving a gap of a predetermined width between the radiation patch and the ground conductor. Thus, especially in case of an array antenna provided with a plurality of antenna elements formed on a single substrate, such whole area covering of the ground conductor can make the arrangement of the unbalanced feed lines extremely easier.

It is preferred that a plurality of pairs of the radiation element conductors are arranged on the substrate in an array.

In an embodiment according to the present invention, each of the radiation patches is formed in a square shape having four sides. The balanced feed line is connected to one of the four sides of the radiation patch at its center.

In an embodiment according to the present invention, each of the radiation patches is formed in a rectangular shape having long sides and short sides which are shorter than the long sides. The balanced feed line is connected to one of the long sides of the radiation patch. Therefore, the feeding point can be freely selected depending upon the characteristics impedance of the balanced feed line so as to obtain impedance matching. As a result, no additional impedance matching section is necessary causing the circuit configuration to become simple and small. This technique is extremely advantageous for realizing a bidirectional radiation rod antenna more simple construction.

The balanced feed line may be connected to the long side of the radiation patch at an off-centered point.

In an embodiment according to the present invention, the antenna further includes at least one pair of parasitic element conductors (parasitic patches) with no feeding. These parasitic patches oppose the radiation patches, respectively. Each of them has substantially the same shape as that of the radiation patch and locates at a position apart from each of the radiation patches by a predetermined distance. Thus, the electric field captured between the parallel patches will be radiated causing the radiation efficiency to extremely increase.

In an embodiment according to the present invention, the antenna further includes at least one slot and a third strip conductor arranged on the first surface to be crossed with the slot. The slot is fed by an unbalanced feed line which consists of the third strip line and the ground conductor. Thus, an antenna which can excite both the vertical and horizontal polarizations or the circular polarization can be easily realized in a simple structure.

A plurality of pairs of the radiation patches and a plurality of the slot may be arranged on the substrate in an array. In this case, the number of the slot is the same as that of the pairs of the radiation patches.

In an embodiment according to the present invention, the unbalanced feed line has a predetermined line length and a predetermined line width so that exciting phase and exciting amplitude of the radiation patches are controlled to a desired phase and to a desired amplitude, respectively. As a result, it is possible to provide an array antenna having a desired radiation characteristics in a simple circuit constitution.

In an embodiment according to the present invention, the antenna further includes a 90° hybrid inserted between the unbalanced feed line for feeding to the radiation patches and the unbalanced feed line for feeding to the slot. Thus. a circular polarization antenna can be provided in a simple structure.

Further objects and advantages of the present invention will be apparent from the following description of the preferred embodiments of the invention as illustrated in the accompanying drawings.

DESCRIPTION OF THE PREFERRED EMBODIMENTS

First Embodiment

Figure 3A:
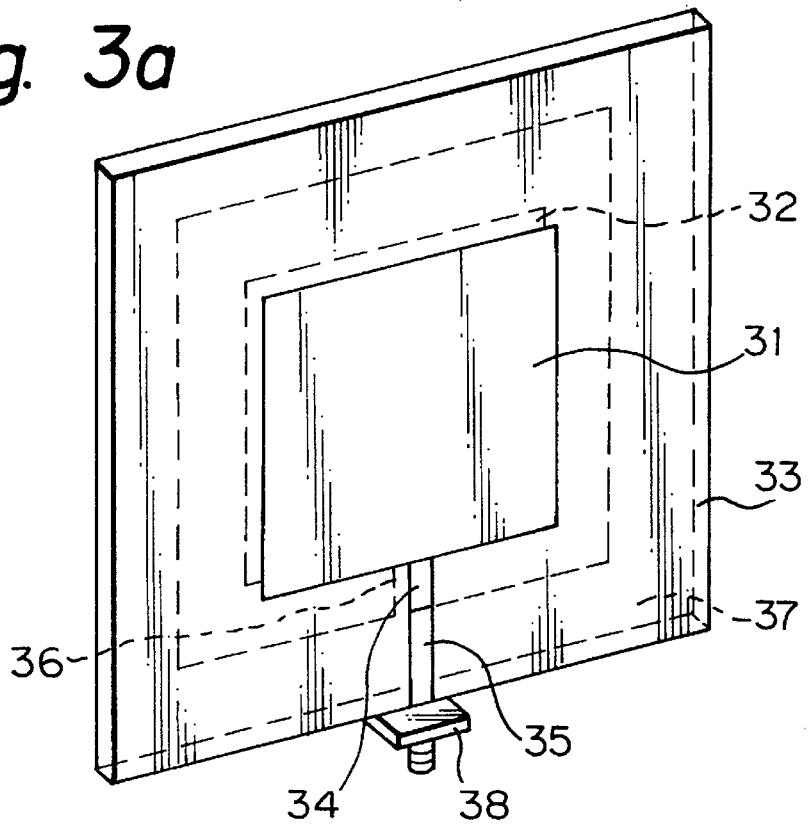
FIGS. 3*a* to 3*e* show a first preferred embodiment of a printed antenna according to the present invention.
Figure 3B:
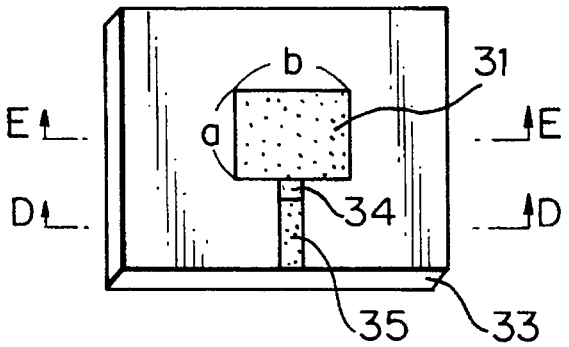
Figure 3D:
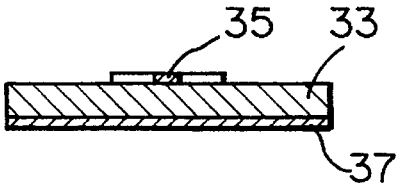
Figure 3C:
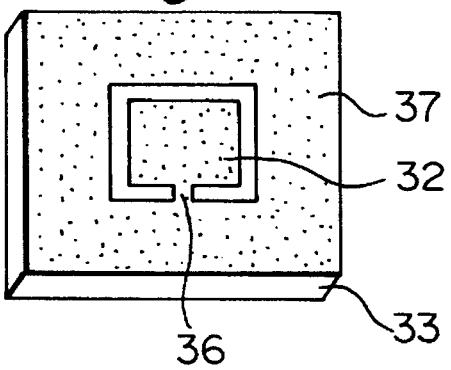
Figure 3E:
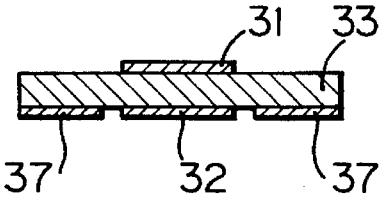

FIGS. 3*a* to 3*e* show an antenna structure of a first preferred embodiment according to the present invention, wherein FIG. 3*a* is an oblique view of this antenna, FIG. 3*b* is an oblique view indicating conductor pattern formed on the front surface of its substrate, FIG. 3*c* is an oblique view indicating conductor pattern formed on the rear surface of the substrate, FIG. 3*d* is a sectional view taken on a D—D line in FIG. 3*b*, and FIG. 3*e* is a sectional view taken on an E—E line in FIG. 3*b*.

In these figures, reference numerals 31 and 32 denote radiation element conductors (radiation patches) formed in a rectangular shape such as a square shape on the both surfaces of the dielectric substrate 33, respectively. These patches 31 and 32 are formed in the same shape and the same size on the respective surfaces of the substrate 33 at positions opposing to each other, namely at plane symmetrical positions.

On the front surface of the substrate 33, strip conductors 34 and 35 are formed other than the radiation patch 31. One end of the strip conductor 35 is coupled to approximately the center of one side of the radiation patch 31 via the strip conductor 34. On the rear surface of the substrate 33, a strip conductor 36 and a ground conductor 37 are formed other than the radiation patch 32. The ground conductor 37 is formed over the remaining whole area around the patch 32 by leaving a gap of a predetermined width between them as clearly shown in FIG. 3*c*. The patch 32 and the ground conductor 37 are connected each other by the strip conductor 36 formed at a position of the gap.

The strip conductors 34 and 36 are located on the respective surfaces of the substrate 33 in parallel at positions opposing to each other, namely at plane symmetrical positions, and thus constitute a balanced feed line. The strip conductor 35 is located on the front surface at a corresponding position where the ground conductor 37 is formed on the rear surface, and thus constitutes with the ground conductor 37 an unbalanced feed line. The other end of the strip conductor 35 is connected to a central conductor (not shown) of a connector 38 and the ground conductor 37 is connected to a ground conductor (not shown) of the connector 38.

The length of the radiation patches 31 and 32 (resonant length) a should be determined in accordance with the resonant frequency taking "fringing effect" into consideration. It is known as "fringing effect" that the length of the radiation patch of such the antenna seems to be electrically longer than its real length a due to possible leakage of electric field from the edge of the patch and that it will resonate at a frequency corresponding to this longer length. Such "fringing effect" is described, for example, in the aforementioned I. J. Bahl and P. Bhartia, "Microstrip Antennas", P57, Artech House, USA, 1980.

Before connecting the radiation patches 31 and 32 with the balanced feed line 34 and 36, according to this embodiment, it may be necessary to realize impedance matching by adjusting their respective impedances to coincide each other or by inserting an impedance matching section between them.

Since the radiation patches 31 and 32 are fed by the parallel feed lines 34 and 36 formed respectively on the opposite surfaces of the substrate 33, these patches 31 and 32 are excited in inverted phase each other. Accordingly, it is possible to radiate beams in directions perpendicular to the surfaces of the printed substrate 33.

Figure 1A:
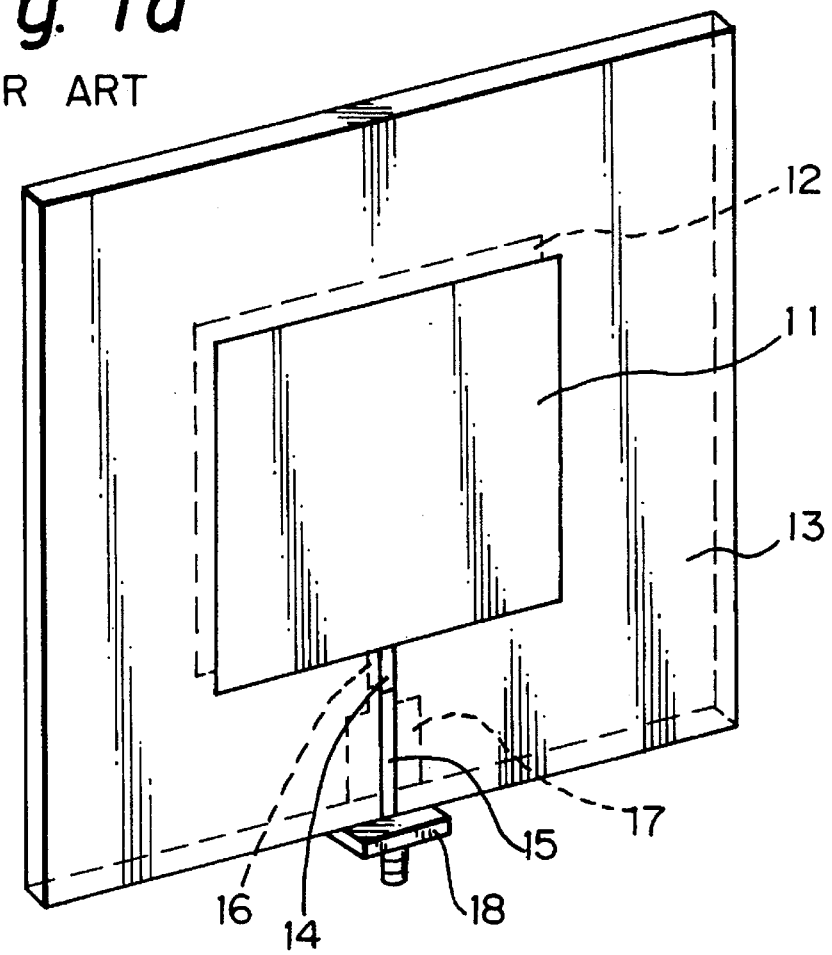
Fig. 1a PRIOR ART
FIGS. 1*a* to 1*c* described already show an example of a conventional parallel patch antenna.
Figure 1B:
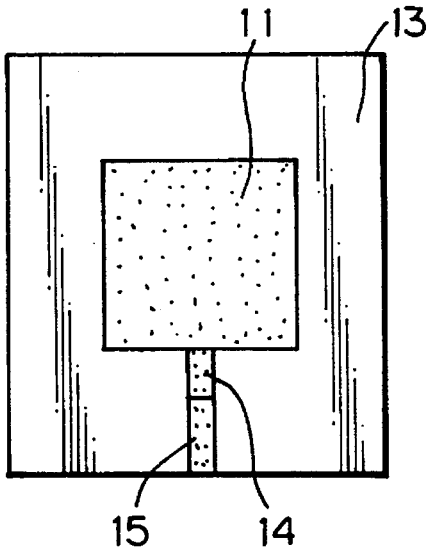
Fig. 1b PRIOR ART
Figure 1C:
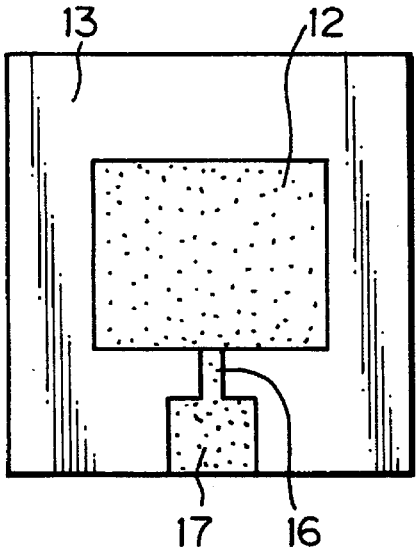
Fig. 1c PRIOR ART
Figure 2A:
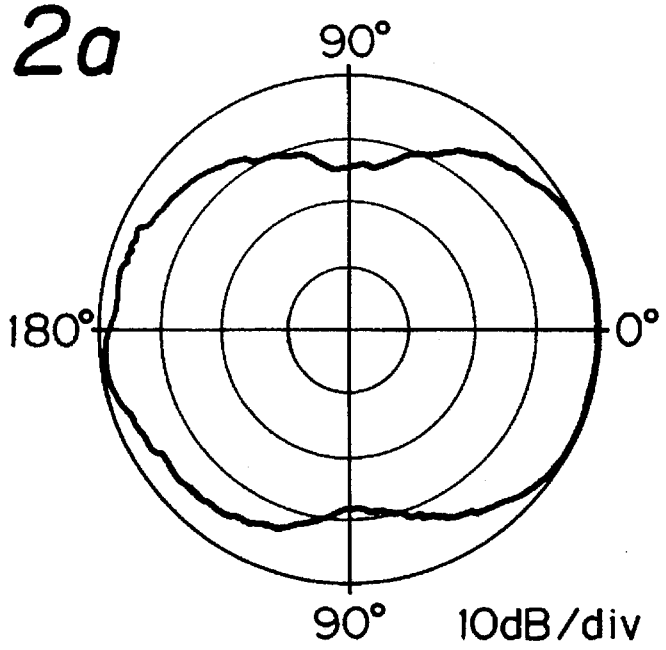
FIGS. 2*a* and 2*b* described already show measured radiation characteristics of the parallel patch antenna of FIGS. 1*a* to 1*c;*
Figure 2B:
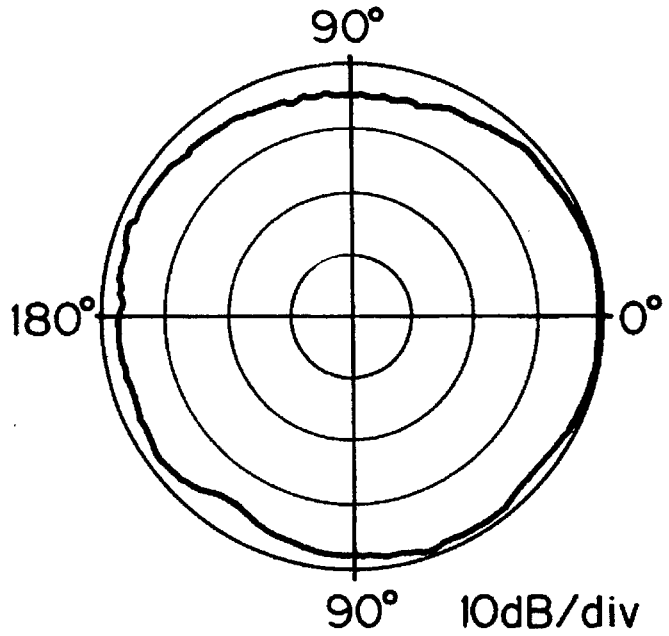

As described before, the conventional parallel patch antenna shown in FIGS. 1*a* to 1*c* has the radiation pattern of omnidirectional or elliptic shape in the E-plane as shown in FIG. 2*b*. However, according to this first embodiment, since on the rear surface of the substrate 33, the ground conductor 37 is formed over the remaining whole area around the patch 32 by leaving a gap of a predetermined width between them, the radiation pattern in the E-plane becomes bidirectional and also the directive gain increases. Thus, a bidirectional antenna with higher gain can be expected. In order to obtain the bidirectional radiation pattern in the E-plane, it is not necessary to form the ground conductor 37 over the whole remaining area around the patch 32 as indicated in FIG. 3*c*, but only necessary to form the ground conductor 37 over the area outside of the edge connected to the feed line 36, of the patch 32 and the area outside of its opposite edge with respect to the patch 32 by leaving a gap of a predetermined width between the conductor 37 and the patch 32. In other words, it is enough that the ground conductor 37 is formed over the areas outside of the edges of the patch 32 in the direction of the resonant length.

However, if the ground conductor 37 is formed over the whole remaining area around the patch 32 as the above-embodiment, the microstrip feed lines on the substrate 33 can be easily distributed. As will be described later, especially in case of an array antenna provided with a plurality of antenna elements formed on a single substrate, such whole area covering of the ground conductor can make the arrangement of the feed lines extremely easier.

Figure 4:
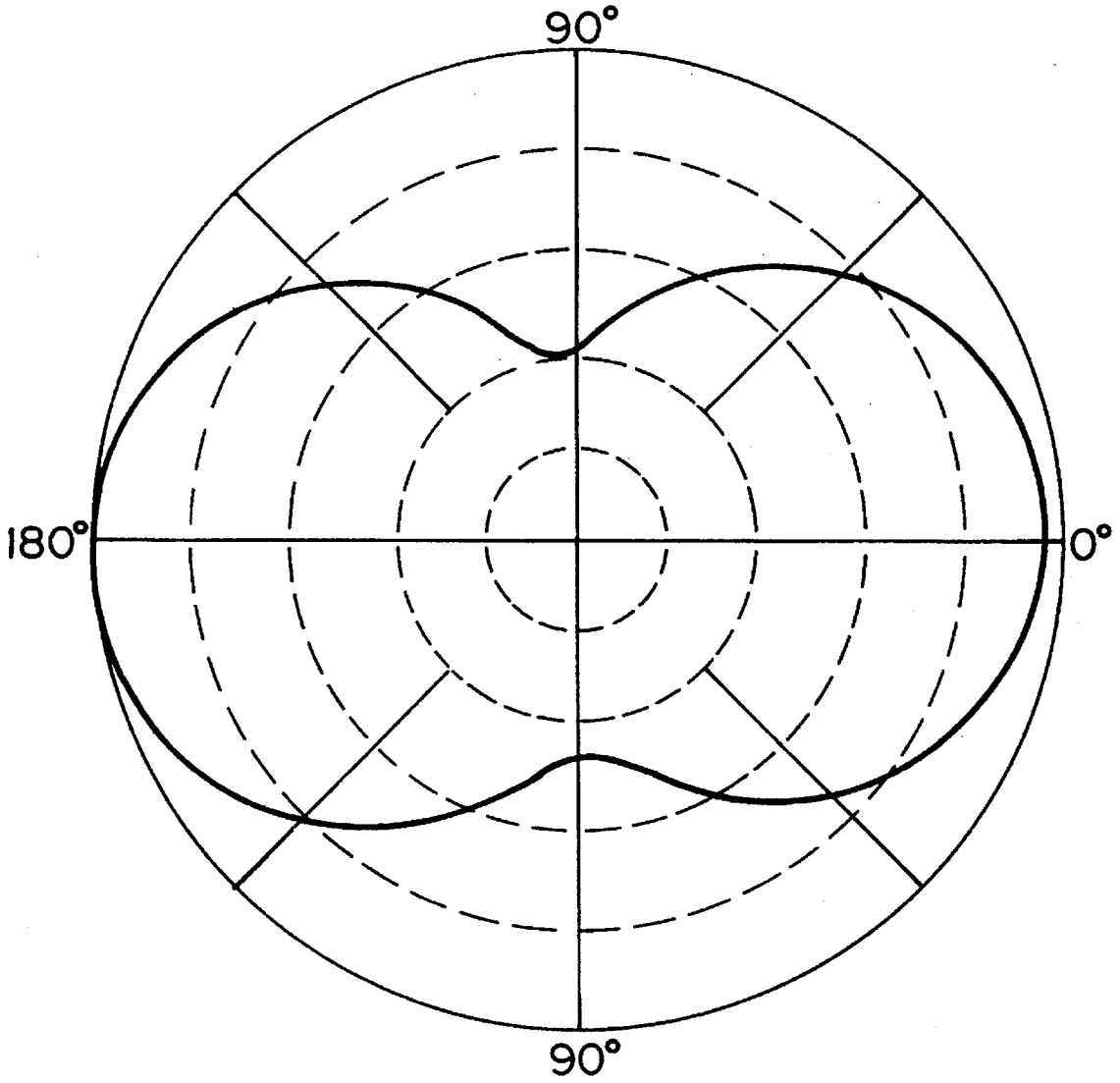
FIG. 4 shows measured radiation characteristics of the antenna of FIGS. 3*a* to 3*e;*

FIG. 4 shows measured radiation characteristics of the printed antenna according to this embodiment shown in FIGS. 3*a* to 3*e*. As will be understood from the figure, the printed antenna of this embodiment can provide bidirectional radiation characteristics even in the E-plane. Parameters for the measurement of this characteristics are the same as these in FIGS. 2*a* and 2*b*. Namely, the substrate 33 is a Teflon glass laminated substrate, formed in a rectangular shape, having a relative dielectric constant of 2.55, thickness of 1.6 mm and size of about 10 cm×10 cm. Also, the radiation patches 31 and 32 are formed in a square shape and the measurement frequency is 2.2 GHz.

The radiation pattern, gain and VSWR characteristics of the printed antenna according to this embodiment will vary depending upon the width of the gap between the ground conductor 37 and the radiation patch 32. If the width of the gap is infinite, namely in case there is no ground conductor 37, the radiation pattern in the E-plane will be omnidirectional as well as that in the conventional art antenna. In case the ground conductor 37 is provided and the width of the gap between the ground conductor 37 and the radiation patch 32 becomes narrower, the radiation pattern in the E-plane will approach bidirectional. Therefore, this width of the gap is determined in accordance with desired radiation pattern, gain and VSWR characteristics of the printed antenna. In fact, this width may be determined equal to or less than approximately ⅕ of the resonant length a of the radiation patch 32 so as to obtain a desired bidirectional radiation pattern.

The frequency band characteristics of the antenna depends on the distance between the radiation patches 31 and 32, which corresponds to the thickness of the dielectric substrate 33. Thus, by appropriately selecting this thickness, a desired frequency band characteristics can be expected.

As described herein-before, the printed antenna according to the present invention is constituted by additionally forming the particular ground conductor in the conventional parallel patch antenna which has different structure as that of the microstrip antenna. Namely, the microstrip antenna is constituted by a substrate, a ground plane conductor formed over the whole area of one surface of the substrate and a radiation element conductor formed on the other surface of the substrate, whereas the conventional parallel patch antenna is constituted by a substrate and two parallel patches, having the same shape and the same size, formed on the both surfaces of the substrate at plane symmetrical positions, respectively. Therefore, the antenna according to the present invention has different structure and differently operates from the microstrip antenna and also from the conventional parallel patch antenna. As aforementioned, according to the present invention, since the ground conductor is formed over the remaining whole area around the radiation patch by leaving a gap of a predetermined width between them, a printed antenna with a bidirectional radiation pattern in both the E-plane and the H-plane can be provided in a simple structure.

In this embodiment shown in FIGS. 3*a* to 3*e*, the radiation patches 31 and 32 are formed in a square shape. However, these patches of the printed antenna according to the present invention can be formed in various shapes other than the square such as circular, ellipse, rectangular, pentagon, triangle, ring or semi disk shape as that of the conventional microstrip patch antenna.

Furthermore, as has been done in the conventional microstrip patch antenna, it is possible to constitute the antenna according to the present invention as that its radiation patches are fed from orthogonal two feed points so as to share two polarizations, that a 90° hybrid is additionally used so as to excite right-handed and left-handed circularly polarized waves, or that the two polarizations are utilized to operate as a diversity antenna.

Second Embodiment

Figure 5:
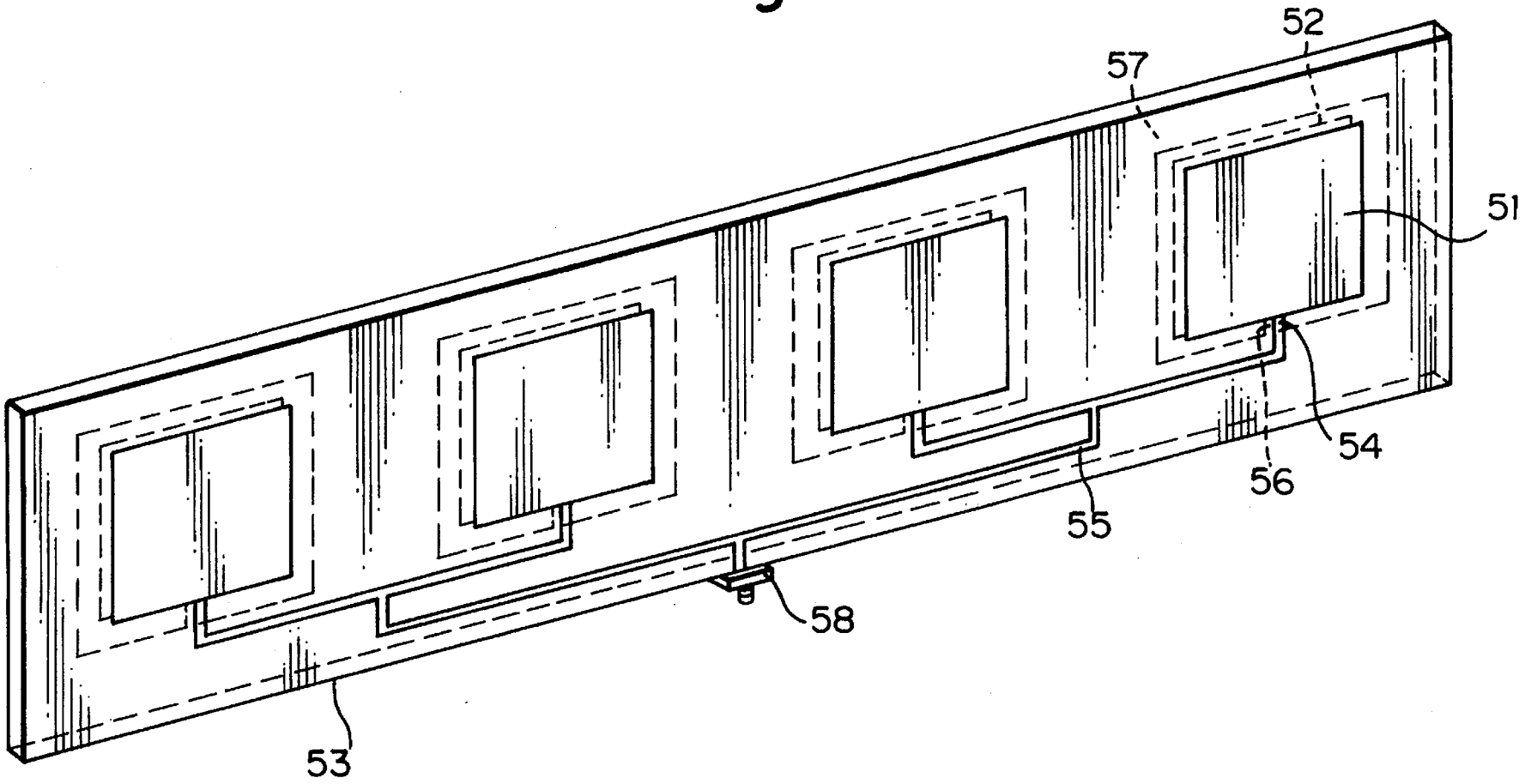
FIG. 5 shows a second preferred embodiment of a printed antenna according to the present invention.

FIG. 5 shows an antenna structure of a second preferred embodiment according to the present invention. This embodiment is an array antenna aligning in the H-plane a plurality (four in this example shown in FIG. 5) of antenna elements each of which corresponds to the antenna element according to the first embodiment.

In the figure, reference numerals 51 and 52 denote four pairs of radiation element conductors (radiation patches) formed in a rectangular shape such as a square shape on the both surfaces of the dielectric substrate 53, respectively. Each pair of these patches 51 and 52 is formed in the same shape and the same size on the respective surfaces of the substrate 53 at positions opposing to each other, namely at plane symmetrical positions.

On the front surface of the substrate 53, four strip conductors 54 and a branched strip conductor 55 are formed other than the radiation patches 51. Each branched end of the strip conductor 55 is coupled to approximately the center of an edge of each of the radiation patches 51 via each of the strip conductors 54. On the rear surface of the substrate 53, four strip conductors 56 and a ground conductor 57 are formed other than the radiation patches 52. The ground conductor 57 is formed over the remaining whole area around each of the patches 52 by leaving a gap of a predetermined width between them. The patches 52 and the ground conductor 57 are connected each other by the respective strip conductors 56 formed at positions of the gap.

Each of the strip conductors 54 and 56 are located on the respective surfaces of the substrate 53 in parallel at positions opposing to each other, namely at plane symmetrical positions, and thus constitute a balanced feed line. The strip conductors 55 are located on the front surface at corresponding positions where the ground conductor 57 is formed on the rear surface, and thus constitutes with the ground conductor 57 an unbalanced feed line. The other end of the blanched strip conductor 55 is connected to a central conductor (not shown) of a connector 58 and the ground conductor 57 is connected to a ground conductor (not shown) of the connector 58. Although the array arrangement in this embodiment is constituted by four antenna elements, the number of the elements can be optionally selected to two or more number.

Since the radiation patches 51 and 52 are fed by the parallel feed lines 54 and 56 formed respectively on the opposite surfaces of the substrate 53, these patches 51 and 52 are excited in inverted phase each other as well as these in the aforementioned first embodiment. Accordingly, it is possible to radiate beams in directions perpendicular to the surfaces of the printed substrate 53.

As will be assumed from the radiation pattern of the single antenna element in the first embodiment described before, according to this second embodiment, since on the rear surface of the substrate 53, the ground conductor 57 is formed over the remaining whole area around the patches 52 by leaving the gaps of a predetermined width between them, the radiation pattern in the E-plane becomes bidirectional and also the directive gain increases. Thus, a bidirectional antenna with higher gain can be expected. Also the radiation pattern in the H-plane becomes more directional by this array arrangement of a plurality of antenna elements in the H-plane.

Since the ground conductor 57 is formed over the whole remaining area around the patches 52, the feeding distribution lines using an unbalanced feed line to the radiation patches can be easily distributed.

It has been described that the main beams from the printed antenna according to this second embodiment radiate in two directions perpendicular to the surfaces of the printed substrate. However, by varying the exciting amplitude and the exciting phase of each of its antenna elements aligned in the H-plane, pattern synthesis in the H-plane can be freely carried out as well as done in the conventional array antenna. Furthermore, the antenna elements of the antenna according to the present invention may be aligned in the E-plane, may be arranged in two dimensional, or may be arranged in a spherical or conformal configuration.

Another constitution, modification and advantages of this second embodiment are substantially the same as those in the first embodiment shown in FIGS. 3*a* to 3*e*.

Third Embodiment

Figure 6A:
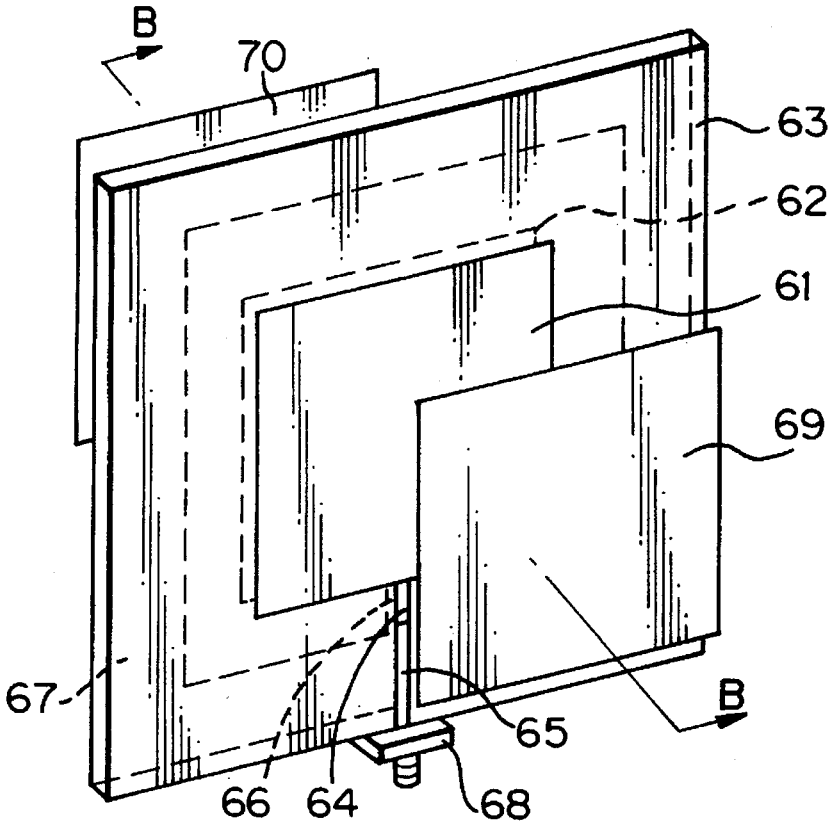
FIGS. 6*a* and 6*b* show a third preferred embodiment of a printed antenna according to the present invention.
Figure 6B:
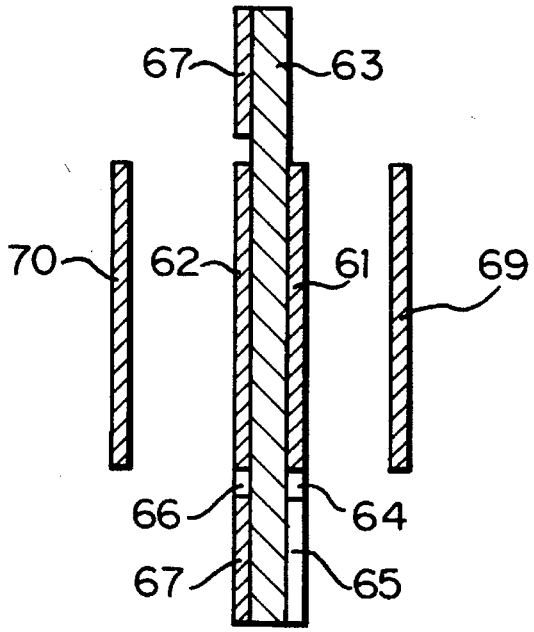

FIGS. 6*a* and 6*b* show an antenna structure of a third preferred embodiment according to the present invention, wherein FIG. 6*a* is an oblique view of this antenna and FIG. 6*b* is a sectional view taken on a B—B line in FIG. 6*a*.

In these figures, reference numerals 61 and 62 denote radiation element conductors (radiation patches) formed in a rectangular shape such as a square shape on the both surfaces of the dielectric substrate 63, respectively. These patches 61 and 62 are formed in the same shape and the same size on the respective surfaces of the substrate 63 at positions opposing to each other, namely at plane symmetrical positions.

On the front surface of the substrate 63, strip conductors 64 and 65 are formed other than the radiation patch 61. One end of the strip conductor 65 is coupled to approximately the center of one edge of the radiation patch 61 via the strip conductor 64. On the rear surface of the substrate 63, a strip conductor 66 and a ground conductor 67 are formed other than the radiation patch 62. The ground conductor 67 is formed over the remaining whole area around the patch 62 by leaving a gap of a predetermined width between them. The patch 62 and the ground conductor 67 are connected each other by the strip conductor 66 formed at a position of the gap.

The strip conductors 64 and 66 are located on the respective surfaces of the substrate 63 in parallel at positions opposing to each other, namely at plane symmetrical positions, and thus constitute a balanced feed line. The strip conductor 65 is located on the front surface at a corresponding position where the ground conductor 67 is formed on the rear surface, and thus constitutes with the ground conductor 67 an unbalanced feed line. The other end of the strip conductor 65 is connected to a central conductor (not shown) of a connector 68 and the ground conductor 67 is connected to a ground conductor (not shown) of the connector 68.

Since the radiation patches 61 and 62 are fed by the parallel feed lines 64 and 66 formed respectively on the opposite surfaces of the substrate 63, these patches 61 and 62 are excited in inverted phase each other. Accordingly, it is possible to radiate beams in directions perpendicular to the surfaces of the printed substrate 63.

As well as the first embodiment, since the ground conductor 67 is formed over the remaining whole area around the patch 62 by leaving a gap of a predetermined width between them, the radiation pattern in the E-plane becomes bidirectional and also the directive gain increases. Thus, a bidirectional antenna with higher gain can be expected. In order to obtain the bidirectional radiation pattern in the E-plane, it is not necessary to form the ground conductor 67 over the whole remaining area around the patch 62, but only necessary to form the ground conductor 67 over the area outside of the edge connected to the feed line 66, of the patch 62 and the area outside of the opposite edge with respect to the patch 62 by leaving a gap of a predetermined width between the conductor 67 and the patch 62. In other words, it is enough that the ground conductor 67 is formed over the areas outside of the edges of the patch 62 in the direction of the resonant length.

However, if the ground conductor 67 is formed over the whole remaining area around the patch 62 as the above-embodiment, the microstrip feed lines on the substrate 63 can be easily distributed. Especially in case of antenna array provided with a plurality of antenna elements formed on a single substrate, such whole area covering of the ground conductor can make the arrangement of the feed lines extremely easier.

This embodiment differs from the first embodiment in a point that two parallel parasitic element conductors (parasitic patches) 69 and 70 with no feeding, which oppose to the respective radiation patches 61 and 62, are additionally arranged so as to increase the radiation efficiency. Each of the parasitic patches 69 and 70 has the same shape and the same size as that of the radiation patch 61 (62), and locates at a position apart from the substrate 63 by a predetermined distance of for example about 1/10 of the wave length.

In the conventional parallel patch antenna shown in FIGS. 1*a* to 1*c*, if the distance between the radiation patches 11 and 12 (thickness of the dielectric substrate 13) is small, the electric field will be captured between these parallel patches causing its radiation efficiency to reduce. Contrary to this, if this distance is larger than a certain length, higher mode will be produced between the parallel patches and thus a desired radiation pattern cannot be expected. Also, in case the feeding is not balanced, the radiation efficiency will be increased but its bidirectional characteristics will deteriorate, namely its front-directional radiation pattern will become different from its rear-directional radiation pattern.

Figure 7:
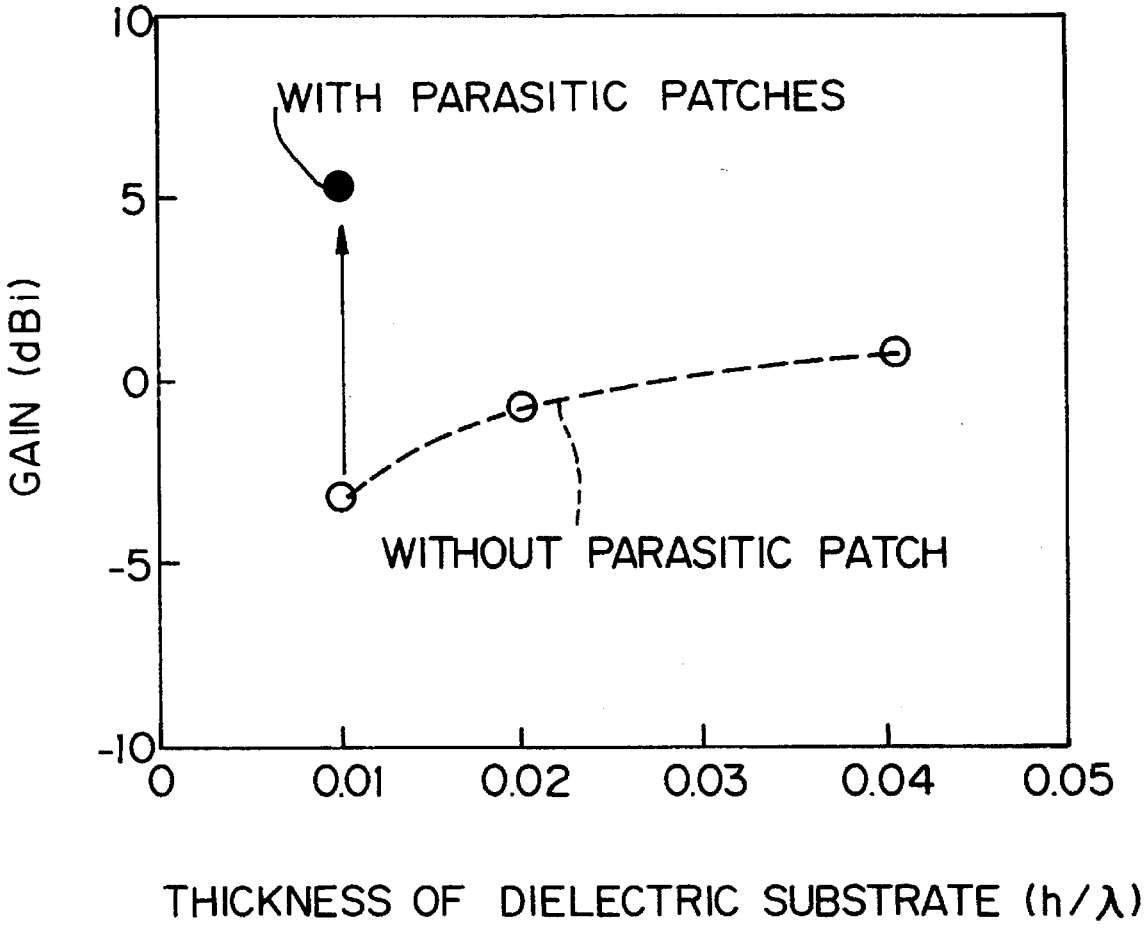
FIG.7 shows advantages of the embodiment shown in FIGS. 6*a* and 6*b;*

In the present embodiment, however, since the two parallel parasitic patches 69 and 70 which oppose to the respective radiation patches 61 and 62 are arranged at positions apart from the substrate 63 by a predetermined distance, the radiation efficiency can be increased. FIG. 7 shows calculated results of the gain characteristics with respect to the distance between the parallel patches 61 and 62 (h/λ), of the antenna with and without the parasitic patches 69 and 70. As is shown in this figure, in case there is no parasitic patch, the electric field will be captured between the parallel radiation patches and thus the radiation efficiency will be reduced causing the gain to decrease when the distance between the radiation patches h is equal to or less than approximately 0.02 wave length (λ). However, in case the parasitic patches 69 and 70 are additionally arranged, the gain can be improved by about 8 dB when the distance between the radiation patches 61 and 62 (h) is equal to approximately 0.01 wave length (λ)

Using of parasitic conducting elements with no feeding in the conventional microstrip antenna so as to broaden its frequency band is known by for example T. Hori and N. Nakajima, "Broadband Circularly Polarized Microstrip Array Antenna with Coplanar Feed", Electronics and Communications in Japan, Part 1, Vol. 69, No.11, 1986. However, as previously mentioned, the antenna according to the present invention operates differently from such the microstrip antenna and thus according to this embodiment, the parasitic patches 69 and 70 are utilized so as to increase its radiation efficiency, not to broaden its frequency band.

Furthermore, it will be understood that even if such parasitic patches are attached to the conventional parallel patch antenna shown in FIGS. 1*a* to 1*c*, the bidirectional radiation characteristics in the E-plane cannot be obtained. This is because that the radiation pattern in the E-plane of the conventional parallel patch antenna is inherently omnidirectional or elliptic pattern and therefore radiation component directing in a plane of the surface of the substrate (a direction parallel to a plane perpendicular to the E-plane and to the H-plane) will be remained. On the other hand, since the antenna according to this embodiment has the particular ground conductor 67, the bidirectional radiation characteristics can be obtained irrespective of with or without the parasitic patches.

Although the printed antenna according to this third embodiment has only a single antenna element, the constitution of this embodiment can be applied to an array antenna having a plurality of antenna elements. Furthermore, by varying the exciting amplitude and the exciting phase of each of the antenna elements, pattern synthesis can be freely carried out as well as done in the conventional array antenna.

Another constitution, modification and advantages of this third embodiment are substantially the same as those in the first embodiment shown in FIGS. 3*a* to 3*e* and in the second embodiment shown in FIG. 5.

Fourth Embodiment

Figure 8:
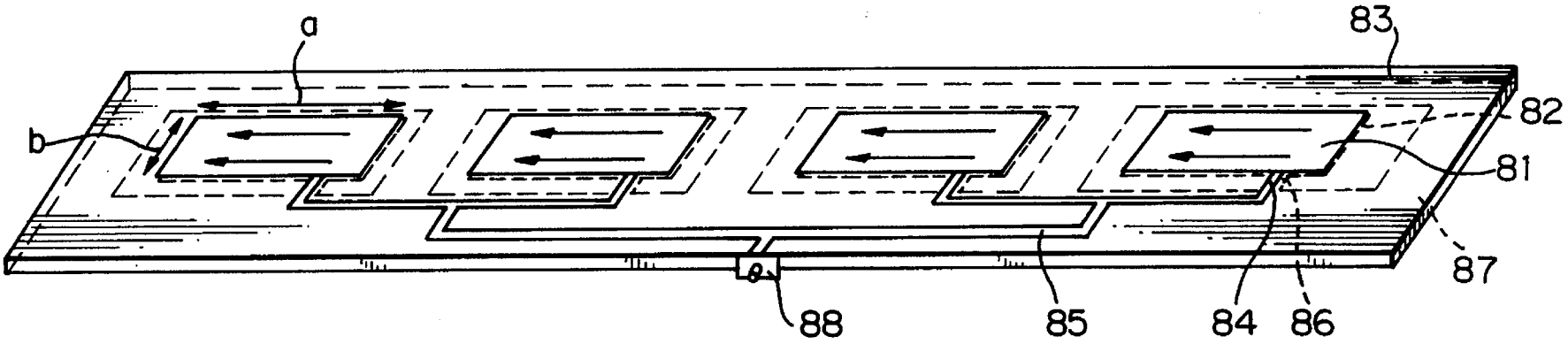
FIG. 8 shows a fourth preferred embodiment of a printed antenna according to the present invention.

FIG. 8 shows an antenna structure of a fourth preferred embodiment according to the present invention. This embodiment is an array antenna aligning in the E-plane a plurality (four in this example shown in FIG. 8) of antenna elements each of which is constituted by modifying the shape of the antenna element according to the first embodiment to a strip shape.

In the figure, reference numerals 81 and 82 denote four pairs of radiation element conductors (radiation patches) formed in a strip shape on the both surfaces of the dielectric substrate 83, respectively. Each pair of these patches 81 and 82 is formed in the same shape and the same size on the respective surfaces of the substrate 83 at positions opposing to each other, namely at plane symmetrical positions.

On the front surface of the substrate 83, four strip conductors 84 and a branched strip conductor 85 are formed other than the radiation patches 81. Each branched end of the strip conductor 85 is coupled to a longer side (having the length a) of each of the radiation patches 81 via each of the strip conductors 84. On the rear surface of the substrate 83, four strip conductors 86 and a ground conductor 87 are formed other than the radiation patches 82. The ground conductor 87 is formed over the remaining whole area around each of the patches 82 by leaving a gap of a predetermined width between them. The patches 82 and the ground conductor 87 are connected each other by the respective strip conductors 86 formed at positions of the gap.

Each of the strip conductors 84 and 86 are located on the respective surfaces of the substrate 83 in parallel at positions opposing to each other, namely at plane symmetrical positions, and thus constitute a balanced feed line. The strip conductors 85 are located on the front surface at corresponding positions where the ground conductor 87 is formed on the rear surface, and thus constitutes with the ground conductor 87 an unbalanced feed line. The other end of the blanched strip conductor 85 is connected to a central conductor (not shown) of a connector 88 and the ground conductor 87 is connected to a ground conductor (not shown) of the connector 88. Although the array arrangement in this embodiment is constituted by four antenna elements, the number of the elements can be optionally selected to two or more number.

In the most cases as well as the aforementioned embodiments, the length of the sides of the radiation patches a and b are substantially equal to each other. Namely, each of the radiation patches are formed in a square shape. However, in this fourth embodiment, the radiation patches are designed so that the length of the side b is shorter than a. If the frequency band used is narrow, there will occur no problem to constitute the patches having the side length as b<a. The reason of this is as follows.

Feeding point to the radiation patches is typically determined to the center of its side b. This is because, if the feeding point is off-centered on the side b, the current in the patches will flow in parallel not only with the side a but also with the side b. Thus resonance will also occur at a frequency corresponding to the length of b. However, if it is selected that the side length b is shorter than the side length a, the resonant frequency corresponding the length b will greatly differ from the desired resonant frequency corresponding to the length a and, as a result, this resonance has no influence on the required frequency band.

The fourth embodiment utilizes this concept by determining the length a of the two sides of the radiation patches 81 and 82 to a resonant length corresponding to the desired resonant frequency, by determining the length b of the other two sides to a length shorter than the length a, and by feeding by means of the balanced feed line 85 from an off-centered point on the side of the length a. Thus, this antenna resonates at both the resonance frequencies corresponding to the lengths a and b, and can be utilized as an antenna with a resonant frequency corresponding to the length a since the resonance mode corresponding to the length b will have no effect on the required resonant frequency band.

The impedance at the center point of the side of a of the patches 81 and 82 is substantially 0Ω, and increases as approaching to the end of the side. At the end of the side, the impedance will be more than about 300Ω. In the conventional antenna, feeding is carried out at a point on the side of the length b so as to provide the resonant frequency corresponding to the length a by flowing current in the direction of arrows shown in FIG. 8. Thus, the impedance at the feeding point is high causing an impedance matching section to be provided. This results complicated circuit construction.

On the other hand, according to this embodiment, feeding can be carried out at a point on the side of the length a other than its both ends. This means that the feeding point can be freely selected depending upon the characteristics impedance of the balanced feed line so as to obtain impedance matching. Therefore no additional impedance matching section is necessary causing the circuit configuration to become simple and small. This technique is extremely advantageous for realizing a printed antenna according to the present invention, and thus a bidirectional radiation antenna can be provided with more simple construction.

Another constitution, modification and advantages of this fourth embodiment are substantially the same as those in the first embodiment shown in FIGS. 3*a* to 3*e* and in the second embodiment shown in FIG. 5.

Fifth Embodiment

Figure 9C:
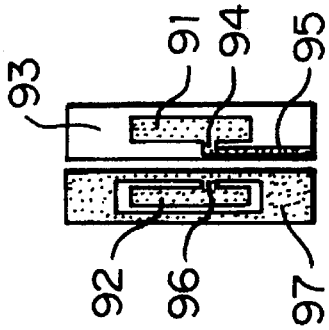
FIGS. 9*a* to 9*c* show a fifth preferred embodiment of a printed antenna according to the present invention.
Figure 9B:
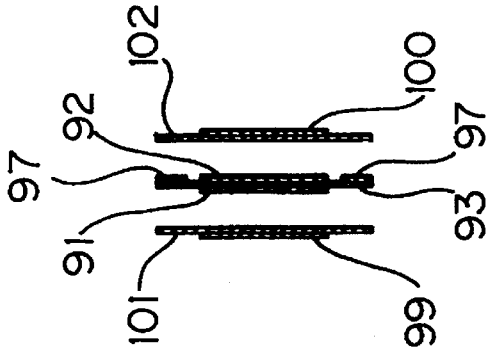
Figure 9A:
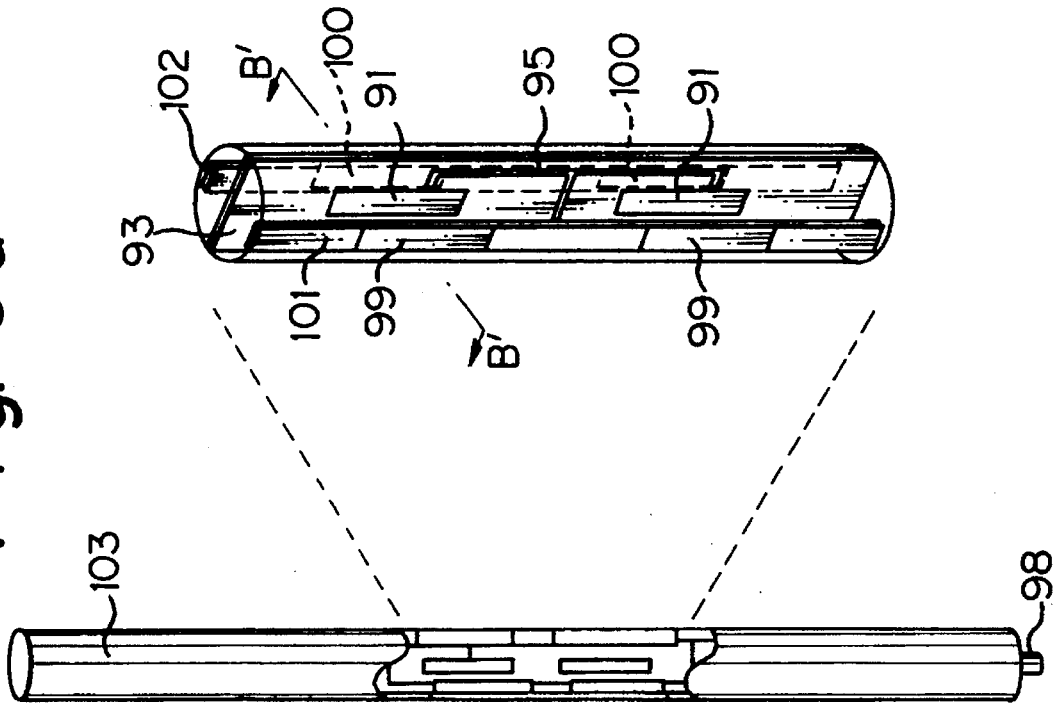

FIGS. 9*a* to 9*c* show an antenna structure of a fifth preferred embodiment according to the present invention, wherein FIG. 9*a* is a partially broken oblique view of this antenna and its partially enlarged oblique view, FIG. 9*b* is a sectional view taken on a B'—B' line in FIG. 9*a*, and FIG. 9*c* is a plane view indicating conductor patterns formed on the front and rear surfaces of its substrate.

This embodiment is a concrete example of an array antenna shown in FIG. 8 provided with parasitic patches shown in FIGS. 6*a* and 6*b* and housed in a cylindrical radome.

In these figures, reference numerals 91 and 92 denote pairs of radiation element conductors (radiation patches) formed in a strip shape on the both surfaces of the dielectric substrate 93, respectively. Each pair of these patches 91 and 92 is formed in the same shape and the same size on the respective surfaces of the substrate 93 at positions opposing to each other, namely at plane symmetrical positions so as to constitute an antenna element.

On the front surface of the substrate 93, strip conductors 94 and a branched strip conductor 95 are formed other than the radiation patches 91. Each branched end of the strip conductor 95 is coupled to a longer side of each of the radiation patches 91 at a off-centered point via each of the strip conductors 94. On the rear surface of the substrate 93, strip conductors 96 and a ground conductor 97 are formed other than the radiation patches 92. The ground conductor 97 is formed over the remaining whole area around each of the patches 92 by leaving a gap of a predetermined width between them. The patches 92 and the ground conductor 97 are connected each other by the respective strip conductors 96 formed at positions of the gap.

The strip conductors 94 and 96 are located on the respective surfaces of the substrate 93 in parallel at positions opposing to each other, namely at plane symmetrical positions, and thus constitute balanced feed lines. The strip conductors 95 are located on the front surface at corresponding positions where the ground conductor 97 is formed on the rear surface, and thus constitute with the ground conductor 97 unbalanced feed lines.

Pairs of parallel parasitic element conductors (parasitic patches) 99 and 100 with no feeding, which oppose to the respective radiation patches 91 and 92, are additionally arranged so as to increase the radiation efficiency. Each of the parasitic patches 99 and 100 has the same shape and the same size as that of the radiation patch 91 (92), and locates at a position apart from the substrate 93 by a predetermined distance of for example about 1/10 of the wave length. These parasitic patches 99 and 100 are formed on auxiliary substrates 101 and 102, respectively.

A plurality of these antenna elements are formed on the substrate 93 and they are housed in a cylindrical radome 103. The other end of the blanched strip conductor 95 is connected to a central conductor (not shown) of a connector 98 which is projected from the radome 103 and the ground conductor 97 is connected to a ground conductor (not shown) of the connector 98.

Another constitution, modification and advantages of this fifth embodiment are substantially the same as those in the third embodiment shown in FIGS. 6*a* and 6*b* and in the fourth embodiment shown in FIG. 8.

Figure 10B:
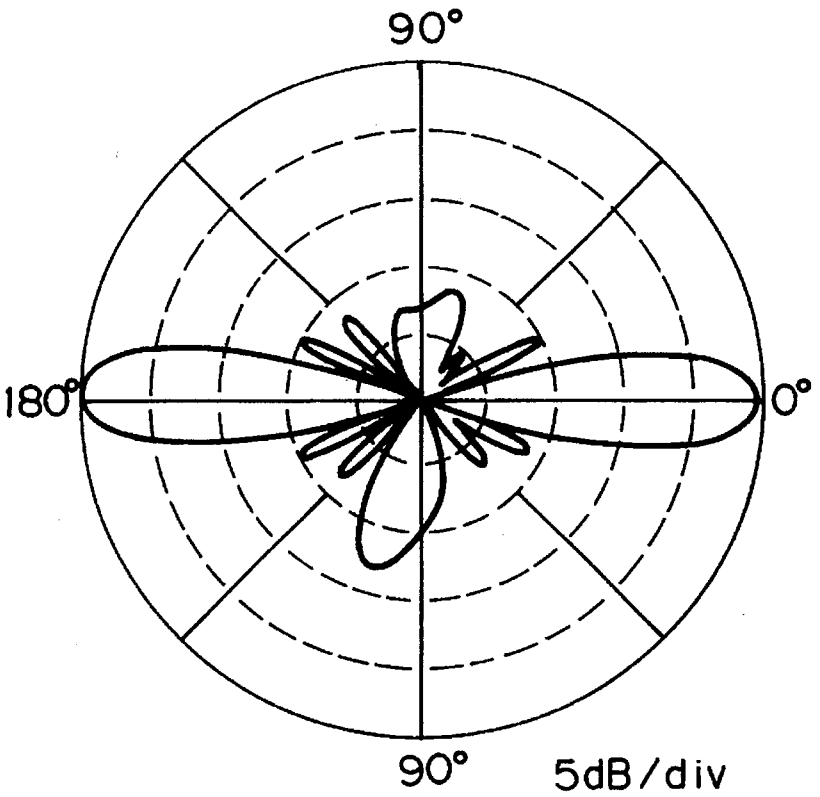
FIGS. 10*a* and 10*b* show measured radiation characteristics of the antenna of FIGS. 9*a* to 9*c;*
Figure 10A:
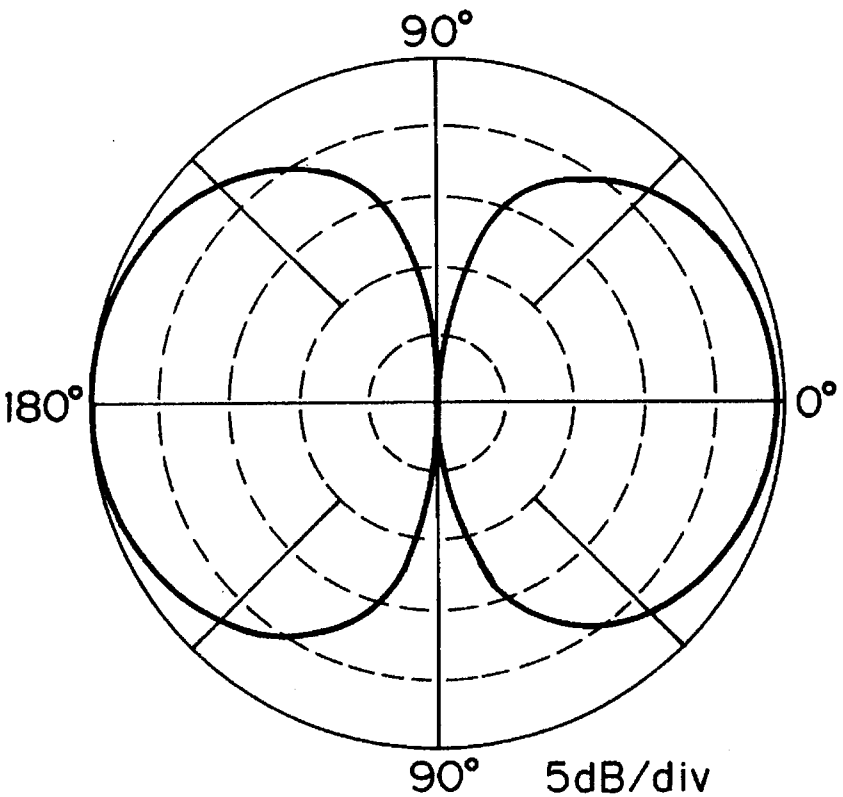

FIGS. 10*a* and 10*b* show the measured result of the radiation characteristics of the antenna according to this embodiment, wherein FIG. 10*a* indicates the radiation pattern in the H-plane and FIG. 10*b* the radiation pattern in E-plane. The measurement of FIGS. 10*a* and 10*b* was carried out by using a Teflon glass laminated substrate 93, formed in a strip shape, having a relative dielectric constant of 2.55, thickness of 1.6 mm and width of 30 mm. Also, the length of the shorter side of the radiation patches was about 10 mm, spaces between the patches was about 0.9 wave length, distance between the radiation patches 91 and 92 and the parasitic patches 99 and 100 was about 10 mm and the measurement frequency was 2.2 GHz.

Since a plurality of antenna elements are arranged in the E-plane in an array, the radiation pattern in this E-plane becomes more directional. Also, since the radiation patches are formed in a strip shape, the radiation pattern in the H-plane becomes bidirectional with a broaden beam width.

Sixth Embodiment

Figure 11:
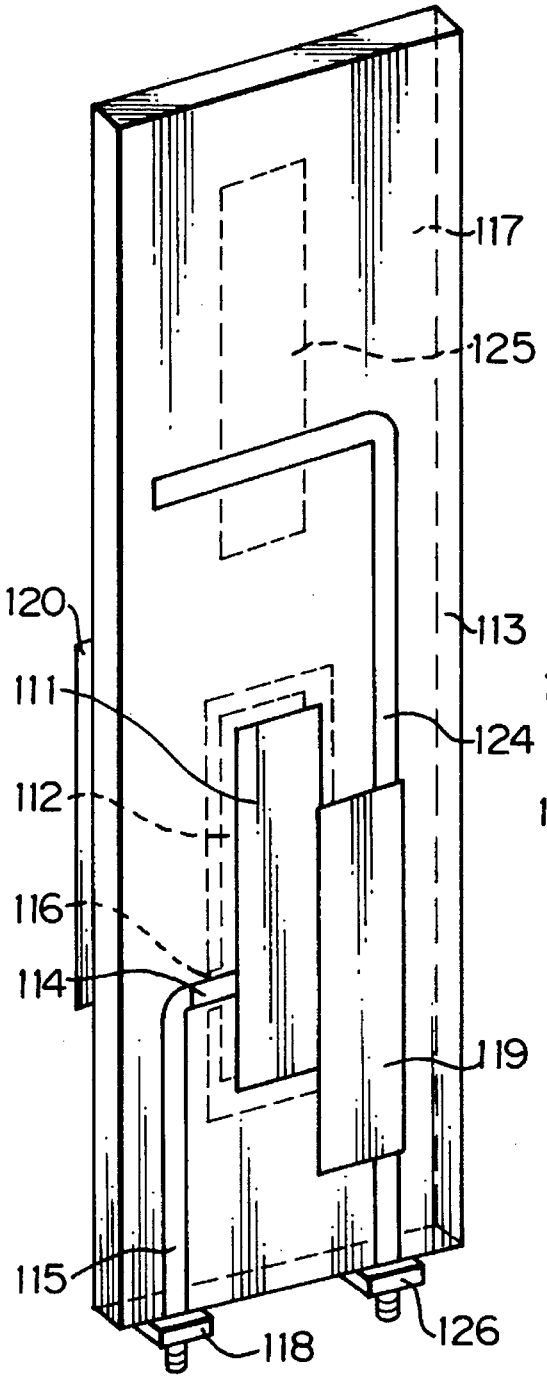
FIG. 11 shows a sixth preferred embodiment of a printed antenna according to the present invention.

FIG. 11 shows an antenna structure of a sixth preferred embodiment according to the present invention. This embodiment is an antenna having a structure which is combined by a bidirectional strip patch antenna and a bidirectional slot antenna.

In the figure, reference numerals 111 and 112 denote radiation element conductors (radiation patches) formed in a strip shape on the both surfaces of the dielectric substrate 113, respectively. These patches 111 and 112 are formed in the same shape and the same size on the respective surfaces of the substrate 113 at positions opposing to each other, namely at plane symmetrical positions.

On the front surface of the substrate 113, strip conductors 114 and 115 are formed other than the radiation patch 111. One end of the strip conductor 115 is coupled to a longer side of the radiation patch 111 via the strip conductor 114. On the rear surface of the substrate 113, a strip conductor 116 and a ground conductor 117 are formed other than the radiation patch 112. The ground conductor 117 is formed around the patch 112 by leaving a gap of a predetermined width between them. The patch 112 and the ground conductor 117 are connected each other by the strip conductor 116 formed at the position of the gap.

The strip conductors 114 and 116 are located on the respective surfaces of the substrate 113 in parallel at positions opposing to each other, namely at plane symmetrical positions, and thus constitute a balanced feed line. The strip conductor 115 are located on the front surface at corresponding positions where the ground conductor 117 is formed on the rear surface, and thus constitutes with the ground conductor 117 an unbalanced feed line. The other end of the strip conductor 115 is connected to a central conductor (not shown) of a connector 118 and the ground conductor 117 is connected to ground conductors (not shown) of the connector 118 and of a connector 126.

Two parallel parasitic element conductors (parasitic patches) 119 and 120 with no feeding, which oppose to the respective radiation patches 111 and 112, are additionally arranged so as to increase the radiation efficiency. Each of the parasitic patches 119 and 120 has the same shape and the same size as that of the radiation patch 111 (112), and locates at a position apart from the substrate 113 by a predetermined distance of for example about 1/10 of the wave length.

This sixth embodiment differs from the third embodiment in the following two points. First, a slot 125 is formed in a strip shape on the substrate 113 within the area where the ground conductor 117 exists at a position aligning with the radiation patch 112. The length of the slot 125 is equal to the resonant length as well as the length of the radiation patches 111 and 112. This slot 125 is produced by omitting this strip shape area of the ground conductor 117 on the rear surface of the substrate 113 as an opening. The ground conductor 117 will be formed over the remaining whole area. Second, on the front surface of the substrate 113, a strip conductor 124 providing with the ground conductor 117 a microstrip (unbalanced) feed line 124 is formed. One end portion of this strip conductor 124 crosses the slot 125, and the other end thereof is connected to a central conductor (not shown) of the connector 126.

According to this embodiment, since the ground conductor 117 is formed over the remaining whole area on the rear surface of the substrate 113, the slot 125 can be arranged in the same planes with the radiation patch 112. Also, since the microstrip feed line 124 is arranged within the area of the ground conductor 117, feeding to the slot 125 can become easier and thus it is possible to independently operate the slot 125 with respect to the radiation patches 111 and 112. In this case, the patches 111 and 112 will radiate vertical polarization and the slot 125 will radiate horizontal polarization. Thus it is possible to realize a shared polarization antenna and also to provide a diversity antenna using both the vertical and horizontal polarizations.

Another constitution, modification and advantages of this sixth embodiment are substantially the same as those in the third embodiment shown in FIGS. 6*a* and 6*b* and in the fourth embodiment shown in FIG. 8.

Seventh Embodiment

Figure 12:
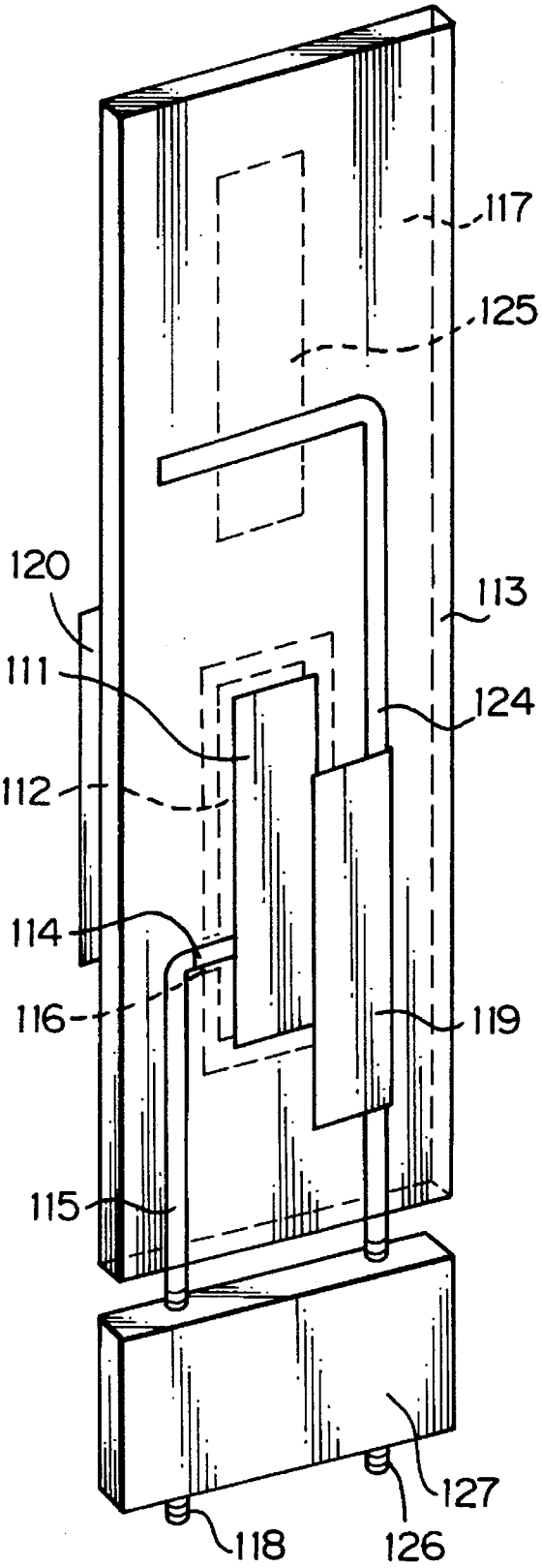
FIG. 12 shows a seventh preferred embodiment of a printed antenna according to the present invention.

FIG. 12 shows an antenna structure of a seventh preferred embodiment according to the present invention. This embodiment is an antenna wherein a 90° hybrid for power synthesis is added to the antenna structure, shown in FIG. 11, combined by a bidirectional strip patch antenna and a bidirectional slot antenna, so that both right-handed and left-handed circular polarization can be radiated.

The antenna shown in FIG. 12 has the same constitution as that of the antenna shown in FIG. 11 except that this antenna has the 90° hybrid 127. Thus, in FIG. 12, the same reference numerals are used for the similar elements as these in the sixth embodiment shown in FIG. 11.

In this embodiment, the line length and the line width of the unbalanced feed line (strip conductors 115) to the radiation patches 111 and 112 and of the unbalanced feed line (strip conductor 124) to the slot 125 are designed so that the exciting phase and exciting amplitude at the patches and the slot coincide with each other, respectively. Thus, by means of the 90° hybrid 127, the polarizations can be fed to the orthogonal polarization (vertical and horizontal polarizations) antenna elements with a phase difference of 90°, respectively, and accordingly a circular polarization can be excited.

In this embodiment, the 90° hybrid 127 is mounted separately from the dielectric substrate 113. However, in a modification, this hybrid may be formed on the substrate 113.

The conventional circular polarization antenna such as a cross dipole antenna is constituted by perpendicularly crossing two antennas which have different radiation patterns in the E-plane and in the H-plane. Thus, due to the radiation pattern difference between the both planes, its ellipticity becomes poor in the directions other than the main beam direction causing no circular polarization to be provided. On the other hand, the antenna according to this seventh embodiment can be constituted so that the radiation pattern of the patches 111 and 112 in the E-plane and the radiation pattern of the slot 125 in the H-plane, and also the radiation pattern of the patches 111 and 112 in the H-plane and the radiation pattern of the slot 125 in the E-plane are substantially equal to each other, respectively. Therefore, in the horizontal plane, excellent circular polarization can be obtained over a wider angle. In the vertical plane, however, since the vertical and horizontal polarization elements are located apart from each other, "array effect" may occur causing its ellipticity to become poor in the directions other than the main beam direction.

In this embodiment, the right-handed and left-handed circular polarizations can be selectively excited by selecting either the port 118 or the port 126 as the feeding input. Therefore, the antenna shown in FIG. 12 can operate as a diversity antenna using the right-handed and left-handed circular polarizations as well as the antenna shown in FIG. 11 which can operate as a diversity antenna using the vertical and horizontal polarizations.

Another constitution, modification and advantages of this seventh embodiment are substantially the same as those in the sixth embodiment shown in FIG. 11.

Eighth Embodiment

Figure 13:
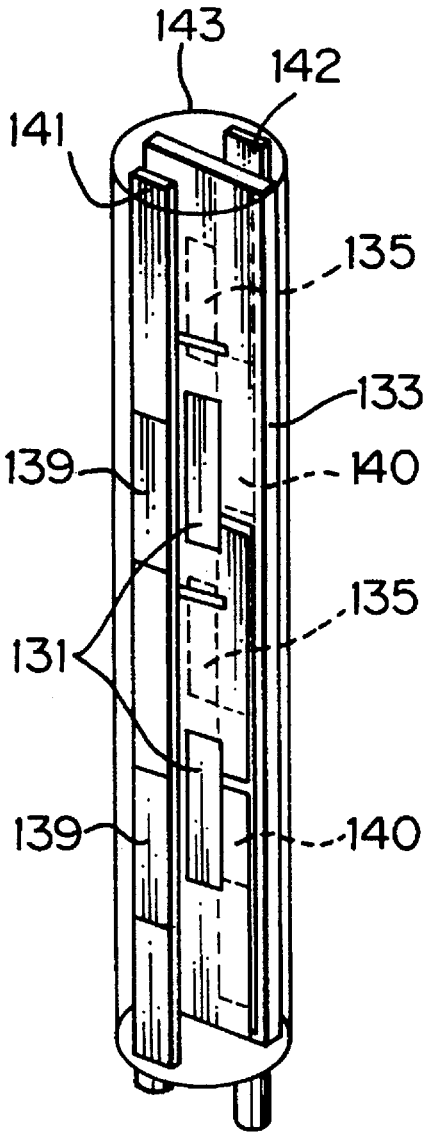
FIG. 13 shows an eighth preferred embodiment of a printed antenna according to the present invention.

FIG. 13 shows an antenna structure of an eighth preferred embodiment according to the present invention.

This embodiment is a concrete example of an array antenna provided with a plurality of the patch-slot combined antenna elements shown in FIG. 11 arranged on substrates and housed in a cylindrical radome.

As shown in the figure, two pairs of radiation patches (131) formed in a strip shape are patterned on the both surfaces of a strip-shaped dielectric substrate 133, respectively. Also, on the substrate 133, two slots 135 are formed in a strip shape within the area where the ground conductor exists at positions aligning with the radiation patches formed on the rear surface of the substrate 133. In this embodiment, each of the radiation patches (131) and each of the slots 135 are alternately aligned along the strip-shaped substrate 133.

Pairs of parallel parasitic patches 139 and 140 with no feeding, which oppose to the respective radiation patches 131, are arranged so as to increase the radiation efficiency. These parasitic patches 139 and 140 are formed on auxiliary substrates 141 and 142, respectively.

According to this eighth embodiment, these two sets of antenna elements each combined by a bidirectional strip patch antenna and a bidirectional slot antenna are housed in a cylindrical radome 143. Although the array arrangement in this embodiment is constituted by two sets of antenna elements, the number of the elements can be optionally selected to two or more number.

Another constitution, modification and advantages of this eighth embodiment are substantially the same as those in the fifth embodiment shown in FIGS. 9*a* to 9*c* and in the sixth embodiment shown in FIG. 11.

Ninth Embodiment

Figure 14:
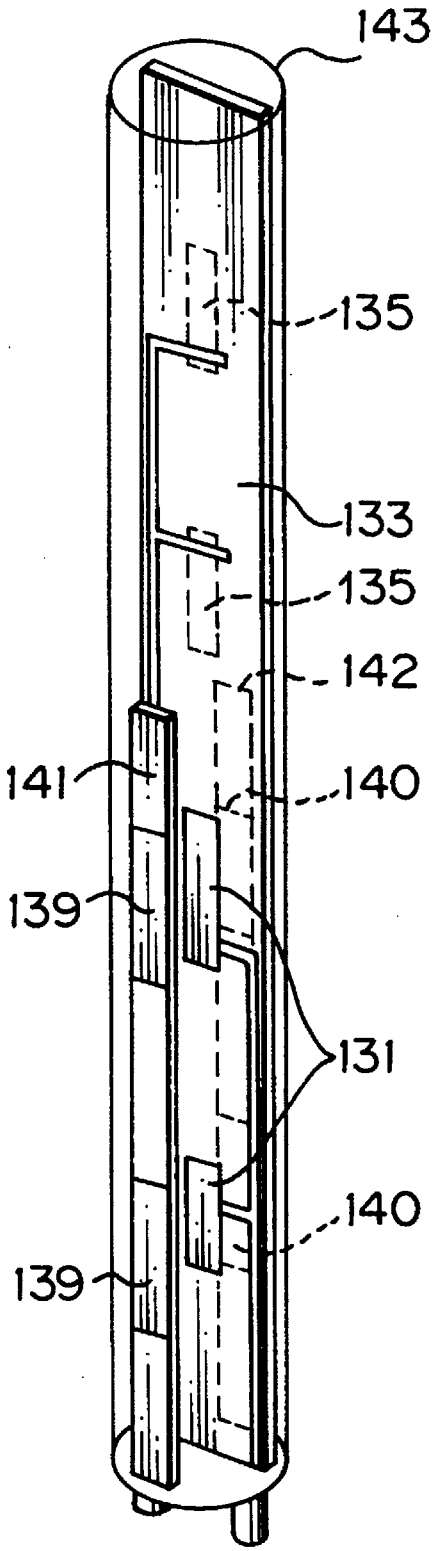
FIG. 14 shows a ninth preferred embodiment of a printed antenna according to the present invention.

FIG. 14 shows an antenna structure of a ninth preferred embodiment according to the present invention.

This embodiment is a concrete example of an array antenna provided with a plurality of the patch-slot combined antenna elements shown in FIG. 11 arranged on substrates and housed in a cylindrical radome as well as the aforementioned embodiment of FIG. 13.

As shown in the figure, two pairs of radiation patches (131) formed in a strip shape are patterned on the both surfaces of a strip-shaped dielectric substrate 133, respectively. Also, on the substrate 133, two slots 135 are formed in a strip shape within the area where the ground conductor exists at positions aligning with the radiation patches formed on the rear surface of the substrate 133. However, in this embodiment, two pairs of the patches (131) are separately arranged from the respective two slots 135 along the strip-shaped substrate 133.

Pairs of parallel parasitic patches 139 and 140 with no feeding, which oppose to the respective radiation patches 131, are also arranged so as to increase the radiation efficiency. These parasitic patches 139 and 140 are also formed on auxiliary substrates 141 and 142, respectively. These two sets of antenna elements each combined by a bidirectional strip patch antenna and a bidirectional slot antenna are housed in a cylindrical radome 143. Although the array arrangement in this embodiment is constituted by two sets of antenna elements, the number of the elements can be optionally selected to two or more number.

Another constitution, modification and advantages of this ninth embodiment are substantially the same as those in the eighth embodiment shown in FIG. 13. Therefore, in FIG. 14, the same reference numerals are used for the similar elements as these in the eighth embodiment shown in FIG. 13.

Many widely different embodiments of the present invention may be constructed without departing from the spirit and scope of the present invention. It should be understood that the present invention is not limited to the specific embodiments described in the specification, except as defined in the appended claims.

What is claimed is:

1. A bidirectional printed antenna comprising:

a dielectric substrate having first and second surfaces which are substantially in parallel;

at least one pair of radiation element conductors having the same shape and the same size, each pair of said radiation element conductors being arranged on said first and second surfaces at positions opposing with each other, respectively;

a feeding circuit coupled to at least one edge of each of said radiation element conductors;

a ground conductor arranged on said second surface, said ground conductor covering at least an area outside of said at least one edge of said radiation element conductor on said second surface, coupled to said feeding circuit, and an area outside of an opposite edge with respect to said radiation element conductor on said second surface by leaving a gap of a predetermined width between the radiation element conductor on said second surface and the ground conductor;

a first strip conductor arranged on said first surface and connected to said radiation element conductor on the first surface; and a second strip conductor arranged on said second surface, for connecting said radiation element conductor on the second surface with said ground conductor, said feeding circuit including a first unbalanced feed line which consists of said ground conductor and said first strip conductor, and a balanced feed line which consists of said first and second strip conductors.

2. The antenna as claimed in claim 1, wherein said ground conductor is arranged around said radiation element conductor of said second surface by leaving a gap of a predetermined width between the radiation element conductor of said second surface and the ground conductor.

3. The antenna as claimed in claim 1, wherein a plurality of pairs of said radiation element conductors are arranged on the substrate in an array.

4. The antenna as claimed in claim 1, wherein each of said radiation element conductors is formed in a square shape having four sides, and wherein said balanced feed line is connected to one of said four sides of each of the radiation element conductors at its center.

5. The antenna as claimed in claim 1, wherein each of said radiation element conductors is formed in a rectangular shape having long sides and short sides which are shorter than said long sides, and wherein said balanced feed line is connected to one of said long sides of each of the radiation element conductors.

6. The antenna as claimed in claim 5, wherein said balanced feed line is connected to said long side of the each of radiation element conductors at an off-centered point.

7. The antenna as claimed in claim 1, wherein said antenna further comprises at least one pair of parasitic element conductors with no feeding, which oppose said radiation element conductors, respectively, each of said parasitic element conductors having substantially the same shape as that of the radiation element conductor and locating at a position apart from each of said radiation element conductors by a predetermined distance.

8. The antenna as claimed in claim 1, wherein said unbalanced feed line has a predetermined line length and a predetermined line width so that exciting phase and exciting amplitude of said radiation element conductors are controlled to a desired phase and to a desired amplitude, respectively.

9. The antenna as claimed in claim 2, wherein said antenna further comprises at least one slot and a third strip conductor arranged on said first surface crossed with said slot, and wherein said slot is fed by a second unbalanced feed line which consists of said third strip conductor and said ground conductor.

10. The antenna as claimed in claim 9, wherein a plurality of pairs of said radiation element conductors and a plurality of said slots are arranged on the substrate in an array, and wherein the number of said slots is the same as that of said pairs of the radiation element conductors.

11. The antenna as claimed in claim 9, wherein said radiation element conductors are formed in a rectangular shape having long sides and short sides which are shorter than said long sides, and wherein said balanced feed line is connected to one of said long sides of the radiation element conductor.

12. The antenna as claimed in claim 9, wherein said antenna further comprises at least one pair of parasitic element conductors with no feeding, which oppose said radiation element conductors, respectively, each of said parasitic element conductors having substantially the same shape as that of the radiation element conductors and locating at a position apart from each of said radiation element conductors by a predetermined distance.

13. The antenna as claimed in claim 9, wherein said second unbalanced feed line has a predetermined line length and a predetermined line width so that exciting phase and exciting amplitude of said radiation element conductors are controlled to a desired phase and to a desired amplitude, respectively.

14. The antenna as claimed in claim 9, wherein said antenna further comprises a 90° hybrid inserted between said first unbalanced feed line for feeding to said radiation element conductors and said second unbalanced feed line for feeding to said slot.

* * * * *